US008458848B1

(12) United States Patent
Dondurur et al.

(10) Patent No.: US 8,458,848 B1
(45) Date of Patent: Jun. 11, 2013

(54) MULTIPLE PAINT ROLLER HOLDER

(75) Inventors: Mehmet Dondurur, Dhahran (SA); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 13/312,886

(22) Filed: Dec. 6, 2011

(51) Int. Cl.
*B05C 17/02* (2006.01)

(52) U.S. Cl.
USPC ..... 15/230.11; 492/13; 492/19

(58) Field of Classification Search
USPC ..... 15/230.11; 492/13, 16, 19
See application file for complete search history.

(56) References Cited

U.S. PATENT DOCUMENTS

| | | | | |
|---|---|---|---|---|
| 2,257,316 | A | 9/1941 | Votaw et al. | |
| 2,805,436 | A | 9/1957 | Christensen et al. | |
| 3,205,526 | A | 9/1965 | Archibald | |
| 3,346,899 | A * | 10/1967 | Murphy | 15/118 |
| 3,593,361 | A | 7/1971 | Welt | |
| 6,141,821 | A | 11/2000 | Chin | |
| 6,219,877 | B1 | 4/2001 | Lowrey et al. | |
| 6,519,800 | B2 * | 2/2003 | Newman et al. | 15/230.11 |
| 6,973,696 | B1 | 12/2005 | Koumarianos | |
| 7,007,337 | B2 | 3/2006 | Finochiaro et al. | |
| 7,043,793 | B2 | 5/2006 | Lu | |
| 7,293,319 | B2 | 11/2007 | Charbeneau | |
| D602,696 | S | 10/2009 | Morad et al. | |
| 2007/0143946 | A1 | 6/2007 | Kim | |
| 2010/0024147 | A1 * | 2/2010 | Watson | 15/230.11 |

FOREIGN PATENT DOCUMENTS

DE 38 13 939 A1 11/1989

OTHER PUBLICATIONS

Hyde Dual Flex Paint Roller, Lab Safety website, http://www.labsafety.com/hyde-dual-flex-paint-roller_s_150027/?isredirect=true, copyright 2011.

* cited by examiner

*Primary Examiner* — Laura C Guidotti
(74) *Attorney, Agent, or Firm* — Richard C. Litman

(57) ABSTRACT

The multiple paint roller holder includes a roller frame and a handle connected to the roller frame. The handle is preferably connected to the frame by a bent or angled neck to place the handle in a raised position. The roller frame includes an upper cross member having corresponding upper roller holding pins, a lower cross member having corresponding lower roller holding pins, and an extendable center beam interconnecting the upper and lower cross members. Each pair of upper roller holding pin and lower roller holding pin rotatably holds a paint roller therebetween. The extendable center beam allows temporary lengthening of the center beam to facilitate mounting and removal of a plurality of paint rollers disposed vertically within the frame. The multiple paint rollers held thereby facilitate faster painting of surfaces.

7 Claims, 2 Drawing Sheets

MULTIPLE PAINT ROLLER HOLDER

BACKGROUND OF THE INVENTION

1. Field of the Invention

The present invention relates to painting devices, and particularly to a multiple paint roller holder that provides fast performance and increased versatility.

2. Description of the Related Art

Painting one's living and working environment to suit one's aesthetics and décor has been a common practice for a long time. Many painting devices are available to facilitate this task, and these devices range from simple paint brushes to powered spray painters. The paint roller is one of the most common painting devices in current use. These typically include a single paint roller rotatably mounted to a holder. A handle is usually attached to the holder for the user to push and pull during the process of painting a surface. While the conventional paint roller can paint surfaces satisfactorily, it is a time-consuming and inefficient activity. The user must repeatedly dip the roller in a pan of paint because the amount of paint or charge in the roller usually does not last long. This also leads to constant repainting over sections already worked in an effort to obtain an even coat due to uneven application of paint from a near-depleted roller. Moreover, the construction of the typical paint roller devices limits the painting strokes to the vertical, up and down directions on the surface being painted.

Thus, a multiple paint roller holder solving the aforementioned problems is desired.

SUMMARY OF THE INVENTION

The multiple paint roller holder includes a roller frame and a handle connected to the roller frame. The handle is preferably connected to the frame by a bent or angled neck to place the handle in a raised position. The roller frame includes an upper cross member having corresponding upper roller holding pins, a lower cross member having corresponding lower roller holding pins, and an extendable center beam interconnecting the upper and lower cross members. Each pair of upper roller holding pins and lower roller holding pins rotatably holds a paint roller therebetween. The extendable center beam allows temporary lengthening of the center beam to facilitate mounting and removal of a plurality of paint rollers disposed vertically within the frame. The multiple paint rollers held thereby facilitate faster painting of surfaces.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
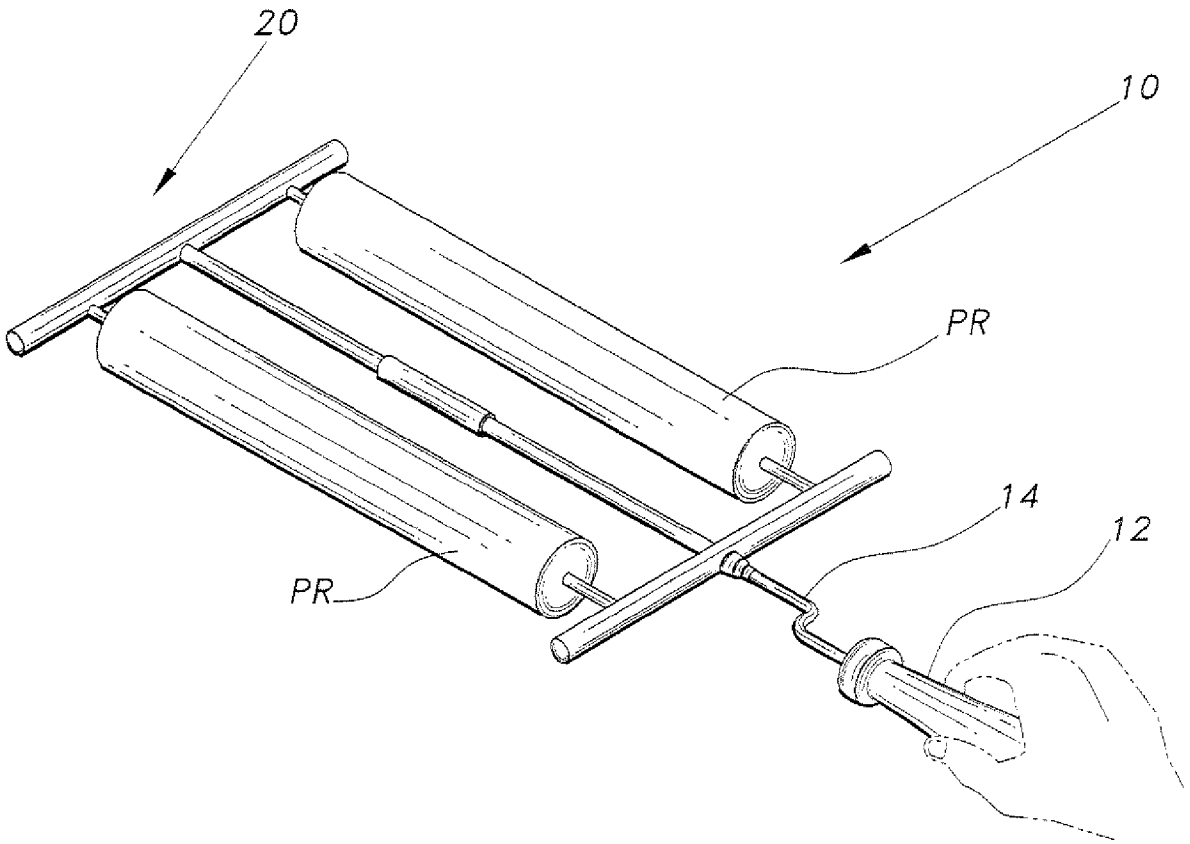
FIG. 1 is an environmental, perspective view of a multiple paint roller holder according to the present invention.
Figure 2:
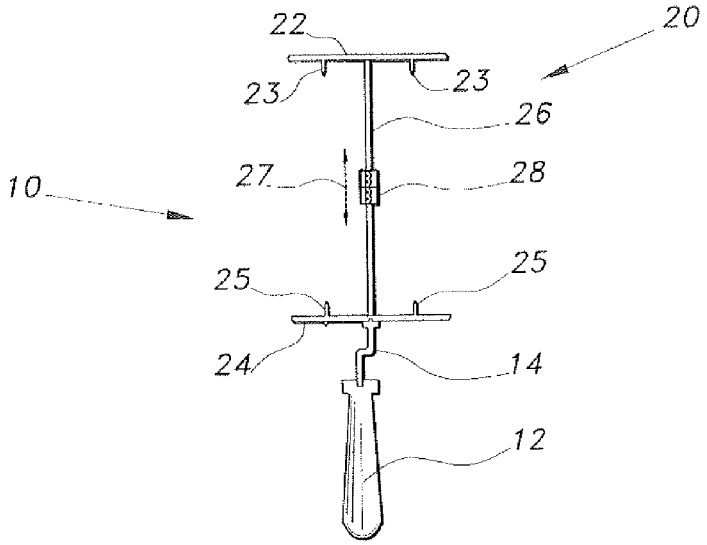
FIG. 2 is a plan view of the multiple paint roller holder shown in FIG. 1.

The multiple paint roller holder, a first embodiment of which is generally referred to in the drawings by the reference number 10, provides faster execution of the task with improved versatility for painting in various directions. As shown in FIGS. 1 and 2, the multiple paint roller holder 10 includes a roller frame 20 for holding a plurality of paint rollers PR and a handle 12 attached thereto. The handle 12 includes an elongate neck 14 mounted directly to the roller frame 20. The connection can be fixed, freely rotating or selectively oriented at an angle. The neck 14 is preferably configured as a bent neck forming a zigzag pattern as shown, or as a straight neck disposed at an angle with respect to the connection to the roller frame 20. The bent neck 14 permits the user to hold the handle 12 at a raised, comfortable position from the surface being painted for moving the roller frame 20 in any desired direction, e.g., horizontal, vertical, arcuate and points between. In this manner, the user can maneuver the multiple painter roller holder 10 without the hand scraping or undesirably touching the painting surface. The handle 12 can be provided in any length and shape from hand-sized to pole length. Although the offset handle is preferred, the handle 12 and neck 14 can be straight and lie substantially in the same plane as the roller frame 20.

As mentioned above, the multiple paint roller holder 10 is constructed to hold a plurality of paint rollers PR. To facilitate this, the roller frame 20 includes an upper cross member, beam, bar or rod 22, a lower cross member, beam, bar or rod 24 spaced from the upper cross member 22, and an elongate, extendable center member, beam, bar or rod 26 disposed between the upper and lower cross members 22, 24, connecting the upper and lower cross members 22, 24 together. The upper cross member 22 includes at least one pair of spaced roller holding pins 23 extending towards the lower cross member 24. In a similar manner, the lower cross member 24 also includes at least a pair of spaced roller holding pins 25 extending towards the upper cross member 22. Each pair of upper roller holding pin 23 and lower holding pin 25 is aligned with each other, and they are constructed to be inserted into the opposite ends of a paint roller PR to rotatably hold the same. With the construction above and shown in FIGS. 1 and 2, two paint rollers PR can be vertically mounted to the roller frame 20 at one time. However, more than the two paint rollers PR can be mounted to the roller frame 20 by lengthening the cross members 22, 24 and adding additional upper and lower roller holding pins 23, 25.

The plurality of paint rollers PR allow for faster and thereby more efficient painting of surfaces because it eliminates much of the repetitious passes required to paint a given surface area compared to a single paint roller holder. With a conventional single paint roller holder, the user must repeatedly paint over the path already traveled by the single paint roller holder because of the splotches left behind in the initial pass. This is often caused by insufficient paint transfer when the paint roller traverses the surface. In contrast, the additional paint roller(s) PR in the multiple paint roller holder 10 substantially reduces the need for such additional passes. The trailing rollers insure that the splotched areas from the leading roller will be covered with paint during a single pass.

The roller frame 20 also includes features for accommodating paint rollers PR of various sizes and easy installation thereof. As shown in FIG. 2, the roller frame 20 includes an extension joint 28 disposed about midway on the center beam 26. The extension joint 28 can house a spring connecting two halves or portions of the center beam 26. This allows the upper portion of the center beam 26, i.e., the portion connected to the upper cross member 22, to resiliently extend in a telescoping manner as shown by the arrow 27, which temporarily lengthens the roller holding frame 20 and widens the gap for installing a paint roller PR. This function can easily facilitate mounting and accommodation of paint rollers with lengths longer than average. Once one end of the paint rollers PR is installed onto the lower roller holding pins 25, the upper portion of the roller frame 20 is released so that the upper roller holding pins 23 insert into the opposite ends of the paint rollers PR. The natural bias of the spring forces the two portions of the center beam 26 toward each other to thereby securely hold the paint rollers PR in the roller frame 20. Alternatively, the extension joint 28 can be a screw-type joint that allows relative telescoping movement between the upper and lower portions of the center beam 26. The center beam 26 can be extended to remove the paint rollers PR.

Figure 3:
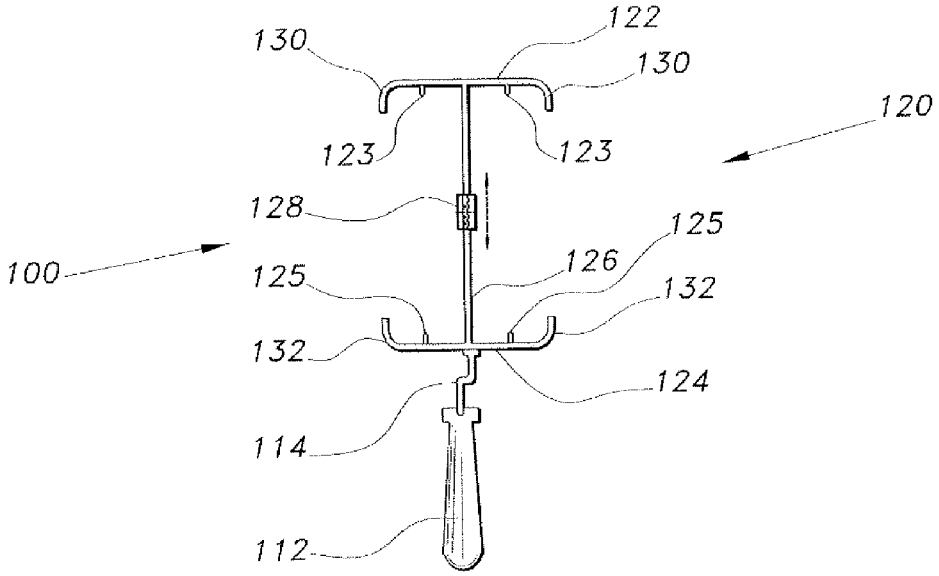
FIG. 3 is a plan view of an alternative embodiment of a multiple paint roller holder according to the present invention.

An alternative embodiment of the multiple paint roller holder 100 is shown in FIG. 3. In this embodiment, the multiple paint roller holder 100 is substantially the same as the multiple paint roller holder 10. The multiple paint roller holder 100 includes a handle 112, a neck 114, an upper cross member 122 having corresponding upper roller holding pins 123, a lower cross member 124 having corresponding lower roller holding pins 125, an extendable center beam 126 and an extension joint 128. However, the upper cross member 122 also includes curved or arcuate outer flanges 130 extending towards the lower cross member 124. Similarly, the lower cross member 124 also includes curved or arcuate outer flanges 132 extending toward the upper cross member 122. The outer flanges 130, 132 are flexible and perform several functions. During installation of the paint rollers PR, the outer flanges 130, 132 can be flexed out of the way to make room for the installation. Moreover, the outer flanges 130, 132 act as guard rails that keep the paint rollers PR inside the roller frame 120 and buffer against any objects that may be in the way of the painting stroke. In all other respects, the multiple paint roller holder 100 functions the same of the multiple paint roller holder 10

Thus, it can be seen that the multiple paint roller holder 10, 100 allows the user to quickly and more efficiently paint desired surfaces. The extendable center beam 26, 126 permits quick and easy installation of various sizes of paint roller PR. The construction thereof is relatively simple, economical and versatile so that the user can paint horizontally as well as vertically with ease.

It is to be understood that the multiple paint roller holder 10, 100 encompasses a variety of alternatives. For example, the multiple paint roller holder can be constructed from wood, plastic, metal, composites and/or combinations thereof. The handle 12, 112 can be of any ergonomic shape ranging from smooth to contoured surfaces.

It is to be understood that the present invention is not limited to the embodiments described above, but encompasses any and all embodiments within the scope of the following claims.

We claim:

1. A multiple paint roller holder, comprising:

a roller holding frame adapted for holding at least a pair of paint rollers in a vertical orientation, the vertical orientation permitting horizontal painting strokes of the multiple paint roller holder, the roller holding frame having:

an elongate upper cross member, the upper cross member having at least two roller holding pins, each of the upper roller holding pins being adapted for rotatably holding one end of a paint roller;

an elongate lower cross member spaced from the upper cross member, the lower cross member having at least two roller holding pins aligned with the upper roller holding pins, each of the lower roller holding pins being adapted for rotatably holding the opposite end of the paint roller, wherein said elongate upper cross member has a pair of curved, outer flanges extending towards said elongate lower cross member from opposite ends of said elongate upper cross member, the outer flanges being symmetrically disposed to form a guard for an outer edge of adjacent paint rollers at one end of said adjacent paint rollers; and an elongate extendable center beam interconnecting the upper cross member and the lower cross member, the upper roller holding pins extending towards the lower cross member, the lower holding pins extending towards the upper cross member; and a handle attached to the roller holding frame, wherein selective extension of the center beam widens access for mounting and detaching paint rollers on and from the roller holding frame, and subsequent retraction of the center beam securely holds the paint rollers inside the roller holding frame.

2. The multiple paint roller holder according to claim 1, further comprising a neck extending from said handle to said roller holding frame.

3. The multiple paint roller holder according to claim 2, wherein said neck is bent to raise said handle above a surface to be painted.

4. The multiple paint roller holder according to claim 3, wherein said neck is bent in a zigzag pattern.

5. The multiple paint roller holder according to claim 1, wherein said center beam comprises an upper portion extending towards said upper cross beam, a lower portion extending towards said lower cross member, and an resiliently biased extension joint connecting the upper portion to the lower portion, the extension joint being biased in a normally retracted state.

6. The multiple paint roller holder according to claim 1, wherein said lower cross member further comprises a pair of curved, outer flanges extending towards said upper cross member from opposite ends of said lower cross member, the outer flanges being symmetrically disposed to form a guard for an outer edge of adjacent paint rollers at the opposite end of adjacent paint rollers.

7. The multiple paint roller holder according to claim 6, wherein said outer flanges of said upper cross member and said lower cross member are flexible to permit access for mounting or removing the paint rollers.

* * * * *